United States Patent [19]

Watanabe

[11] Patent Number: 4,467,748

[45] Date of Patent: Aug. 28, 1984

[54] START CONTROL DEVICE IN FUEL SUPPLY SYSTEM FOR INTERNAL COMBUSTION ENGINE

[75] Inventor: Yukihiro Watanabe, Nagoya, Japan

[73] Assignee: Aisan Kogyo Kabushiki Kaisha, Obu, Japan

[21] Appl. No.: 508,543

[22] Filed: Jun. 28, 1983

[30] Foreign Application Priority Data

Oct. 30, 1982 [JP] Japan ..... 57-191022

[51] Int. Cl.[3] ..... F02N 17/00

[52] U.S. Cl. ..... 123/179 G; 123/179 L; 123/491

[58] Field of Search ..... 123/179 G, 179 L, 491

[56] References Cited

U.S. PATENT DOCUMENTS 3,646,917 3/1972 Nagy ..... 123/491
4,100,892 7/1978 Asano ..... 123/179 G
4,132,210 1/1979 Long ..... 123/179 L
4,352,346 10/1982 Osano et al. ..... 123/179 G
4,364,348 12/1982 Itoh et al. ..... 123/179 G

*Primary Examiner*—Parshotam S. Lall
*Attorney, Agent, or Firm*—Dennison, Meserole, Pollack & Scheiner

[57] ABSTRACT

In combination with a start control device in a fuel supply system for an internal combustion engine including an actuator having a step motor therein as a drive source and a control circuit for controlling the step motor wherein the actuator serves to control at least one of the amounts of fuel and air to be supplied to the engine, the improvement comprising a power-off detecting circuit for detecting stop of power supply to the control circuit, an auxiliary power circuit for supplying electric power to the control circuit and the step motor for a predetermined period of time in response to a detecting signal from the power-off detecting circuit and an actuator driving timer for feeding a predetermined actuating signal to the step motor in response to the detecting signal from the power-off detecting circuit.

10 Claims, 5 Drawing Figures

START CONTROL DEVICE IN FUEL SUPPLY SYSTEM FOR INTERNAL COMBUSTION ENGINE

BACKGROUND OF THE INVENTION

This invention relates to a start control device in a fuel supply system for an internal combustion engine.

In a conventional air-fuel ratio control system 1, as shown in FIG. 1, for controlling an amount of bleed air to be supplied to a slow fuel system and a main fuel system in a carburetor, moisture formed in a combustion chamber 2 by fuel combustion sometimes flows upstream in an air intake pipe 3 or water vapor contained in atmosphere is cooled to form water droplets between needle valves 4 and jets 5. In particular, when the engine is left to stand at low temperatures such as in a cold district, the water droplets are frozen to render the needle valves unoperable. As a result, during the next engine start operation, even when an actuator 7 receives a signal as to close the jets 5 from a control circuit 6, the needle valves 4 cannot move and the jets 5 are held in their opened position. Thusly, the air-fuel ratio of air-and-fuel mixture to be supplied to the engine becomes lean and accordingly, the engine start operation cannot be readily conducted.

In another case where the actuator 7 or the control circuit 6 fails to work during non-use of a vehicle and the needle valves 4 of the actuator 7 cannot be returned to their predetermined start position, the air-fuel ratio of air-and-fuel mixture to be supplied to the engine becomes lean and accordingly, the engine start operation cannot be readily conducted.

SUMMARY OF THE INVENTION

Accordingly, it is an object of the present invention to provide a start control device in a fuel supply system for an internal combustion engine which may supply air-and-fuel mixture having an optimal air-fuel ratio to the engine and readily start the engine even when an actuator for controlling at least one of the amounts of fuel and air does not properly function due to the fact that water moisture in the actuator is frozen or the actuator and/or its control circuit fails to operate.

According to the present invention, a start control device in a fuel supply system for an internal combustion engine includes an actuator having a step motor therein as a drive source and a control circuit for controlling the step motor wherein the actuator serves to control at least one of the amounts of fuel and air to be supplied to the engine. The start control device comprises a power-off detecting circuit for detecting stop of power supply to the control circuit, an auxiliary power circuit for supplying electric power to the control circuit and the step motor for a predetermined period of time in response to a detecting signal from the power-off detecting circuit and an actuator driving timer for feeding a predetermined actuating signal to the step motor in response to the detecting signal from the power-off detecting circuit. With this arrangement, after stopping the engine, the actuator is so controlled as to make optimal at least one of the amounts of fuel and air to be supplied to the engine for the next engine start operation. Accordingly, even when the actuator and the control circuit fails to work, or water moisture in the actuator is frozen in a cold district and the like, thereby causing a control element of the actuator to be unmovable, air-and-fuel mixture having an optimal air-fuel ratio is supplied to the engine, thus enabling the engine to readily perform the start operation.

Other features and advantages of the invention will be apparent from the following description taken in connection with the accompanying drawings.

DETAILED DESCRIPTION OF THE PREFERRED EMBODIMENTS

Figure 1:
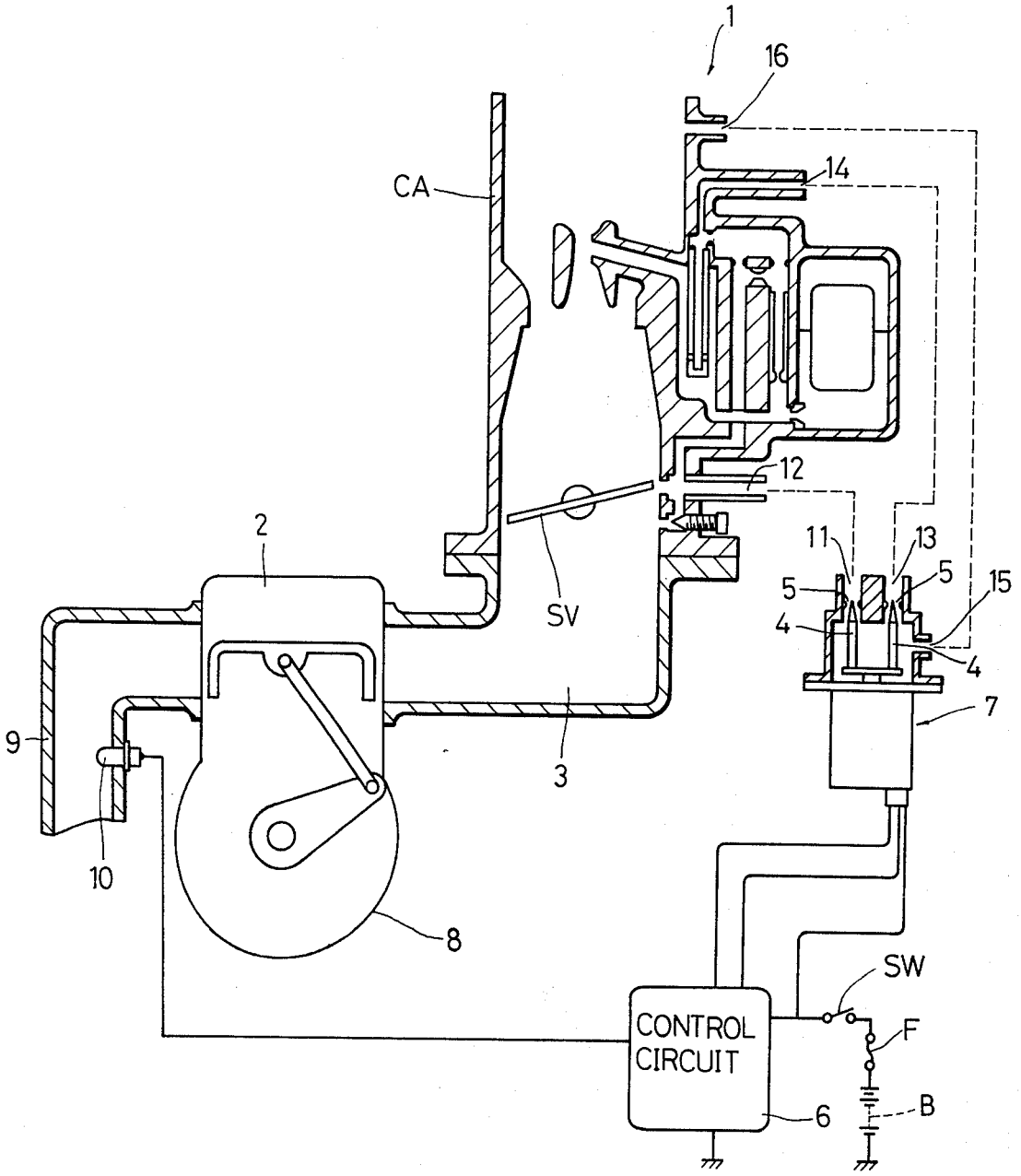
FIG. 1 is a schematic sectional view of the air-fuel ratio control system in the prior art.

Referring now to FIG. 1 which shows an air-fuel ratio control system 1 of the prior art, an exhaust gas sensor 10 such as an exygen sensor is provided at an exhaust manifold 9 of an engine 8. The exhaust gas sensor 10 is connected to the input of the control circuit 6. The output of the control circuit 6 is connected to an actuator 7 for air-fuel ratio control. The actuator 7 accommodates a step motor (not shown) which serves to move the needle valves 4 upwardly or downwardly as viewed in FIG. 1. An output port 11 of the actuator 7 is communicated with an air bleed hole 12 for a slow system formed in the carburetor CA. Another output port 13 of the actuator 7 is communicated with an another air bleed hole 14 for a main system. An input port 15 of the actuator 7 is communicated with an air intake hole 16.

With this arrangement, the control circuit 6 outputs a signal as to operate the actuator 7 in response to a signal outputted from the exhaust gas sensor 10 so as to move the needle valves 4 upwardly or downwardly as viewed in FIG. 1 and achieve an optimal air-fuel ratio. In the case that the signal from the exhaust gas sensor 10 shows richness of the air-fuel ratio of air-and-fuel mixture supplied to the engine, the control circuit 6 outputs a signal as to open the needle valves 4 to the actuator 7 and thereby enlarge the opening area of the jets 5 to increase an amount of bleed air, thus allowing the air-fuel ratio to become leaner in terms of fuel. On the contrary, in the case that the signal from the exhaust gas sensor 10 shows leanness of the air-fuel ratio of air-and-fuel mixture supplied to the engine, the control circuit 6 outputs a signal as to reduce the opening area of the jets 5 to the actuator 7 and decrease the amount of bleed air, thus allowing the air-fuel ratio to become richer in terms of fuel. Reference symbols SV, SW, F and B designate a throttle valve, an ignition switch, a fuse and a battery, respectively.

Figure 2:
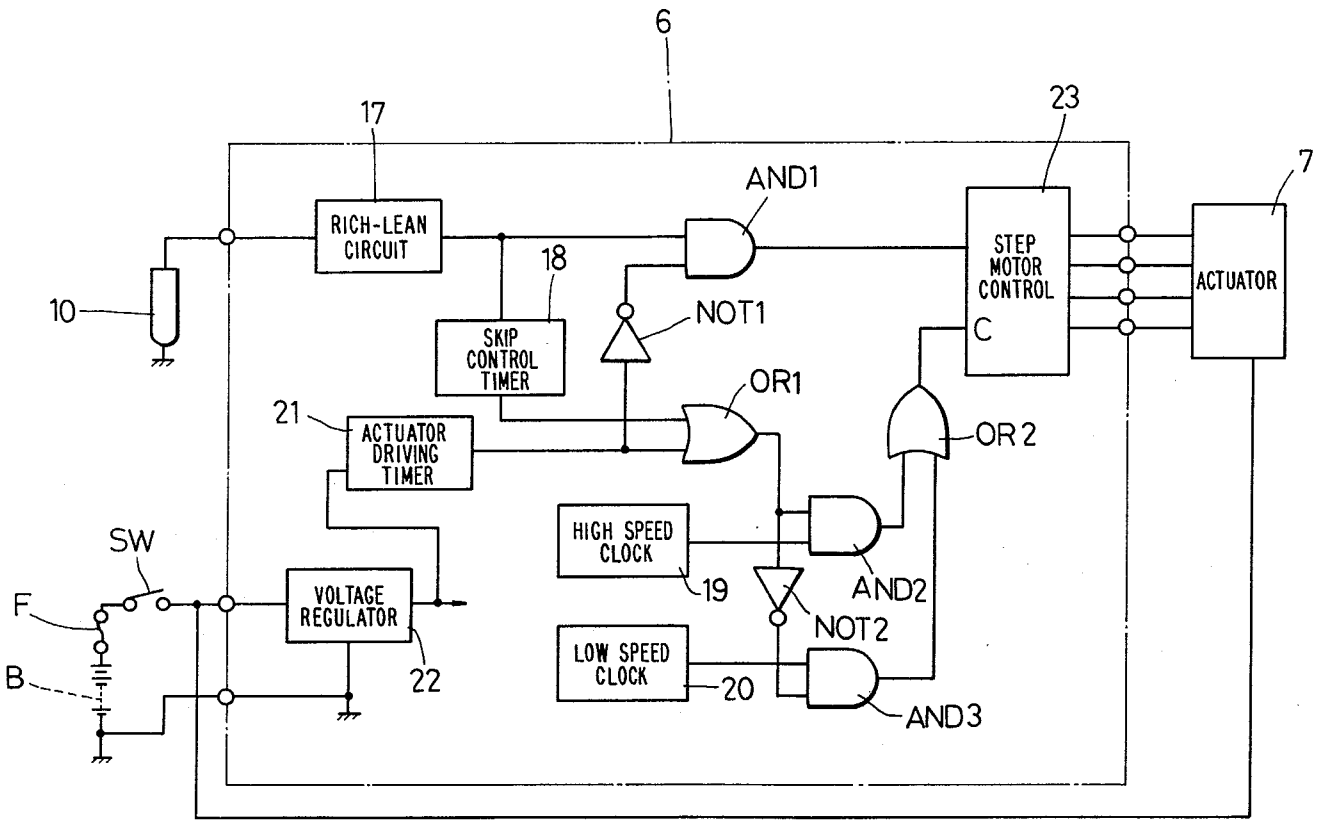
FIG. 2 is a block diagram of the control circuit in the prior art.

Referring next to FIG. 2 which shows a block diagram of the control circuit 6 in FIG. 1, reference numeral 19 designates a high-speed clock circuit for driving a step motor incorporated in the actuator 7 at high speeds, and reference numberal 20 designates a low-speed clock circuit for driving the step motor at low speeds.

A richness-leanness determining circuit 17 is designed to output a high level signal (which will be referred to as "H signal".) when the air-fuel ratio of air-and-fuel mixture is rich in terms of fuel in response to a signal from the exhaust gas sensor 10 and on the contrary, to output a low level signal (which will be referred to as "L signal".) when the air-fuel ratio of air-and-fuel mixture is lean in terms of fuel. The H or L signal is inputted through an AND gate AND1 to a step motor driving circuit 23, and is also inputted to a skip control timer 18.

The skip control timer 18 is designed to output the H signal to an OR gate OR1 during a given period of time every time the output signal from the richness-leanness determining circuit 17 is inverted from H to L, and vice versa. When the H signal is outputted from the skip control timer 18, an AND gate AND2 connected to the output of the OR GATE OR1 is opened and accordingly, a high-speed clock signal from the high-speed clock circuit 19 is inputted through an OR gate OR2 to the step motor control circuit 23. On the contrary, when the L signal is outputted from the skip control timer 18, an AND gate AND3 is opened and accordingly, a low-speed clock signal is inputted from the low-speed clock circuit 20 through the OR gate OR2 to the step motor control circuit 23.

The step motor control circuit 23 serves to output a pulse signal for driving the step motor in the forward or reverse rotation corresponding to the H or L signal inputted from the richness-leanness determining circuit 17 through the AND gate AND1. The period of the pulse signal to be outputted from the step motor control circuit 23 is determined by the period of a clock pulse to be inputted to a clock terminal C of the step motor control circuit 23. Therefore, the step motor is rotated at high or low speeds corresponding to the period of the clock pulse from the high-speed clock circuit 19 or the low-speed clock circuit 20.

Reference numeral 21 designates an actuator driving timer designed to output the H signal during a given period of time when the H signal is inputted to the timer 21. In this embodiment, when the power supply goes on, the H signal is outputted from the timer 21 during a given period of time. When the H signal is outputted from the actuator driving timer 21 for a given period of time, the AND gate AND1 is closed and accordingly, the output from the AND gate AND1 maintains a L signal for a given period of time. As a result of this, the step motor driving circuit 23 outputs a pulse for reversely rotating the step motor of the actuator 7 for a given period of time, wherein the needle valves 4 are designed to move in such a direction as to decrease the opening area of the jets 5, so that the jets 5 are substantially fully closed. During this control operation, a high-speed clock pulse is inputted from the high-speed clock circuit 19 to the step motor control circuit 23, and when the output from the actuator driving timer 21 becomes a H signal, the output from the OR gate OR1 becomes a H signal and thereby the AND gate AND2 is opened. As a result, the jets 5 are fully closed in a short time. Reference numeral 22 is a voltage regulator.

Figure 3:
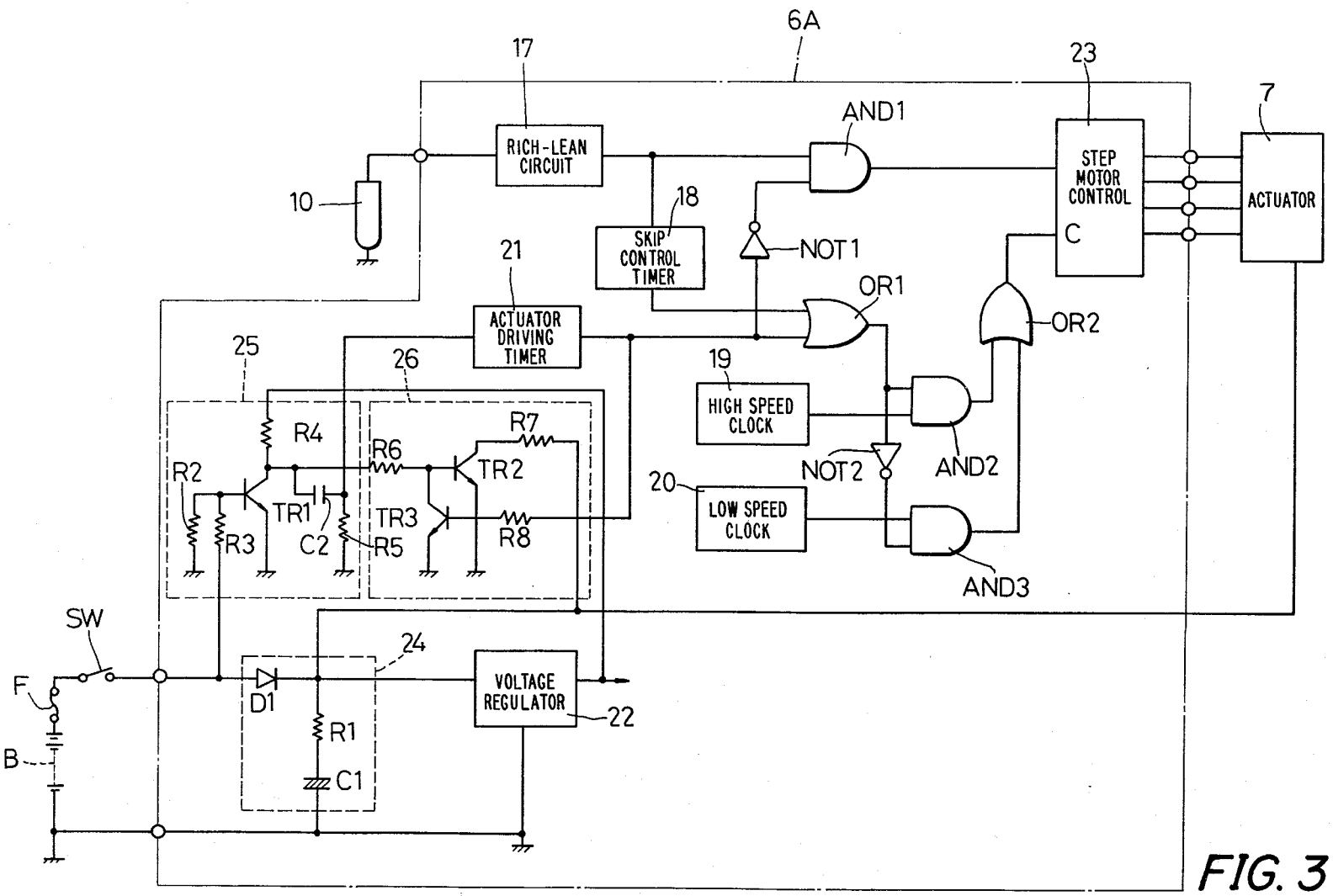
FIG. 3 is a block diagram of the control circuit according to the first embodiment.

Referring next to FIG. 3 which shows a first embodiment of the present invention, a control circuit 6A includes an auxiliary power circuit 24, a power-off detecting circuit 25 and a discharging circuit 26 in addition to the components of the control circuit 6 in FIG. 2.

Figure 4:
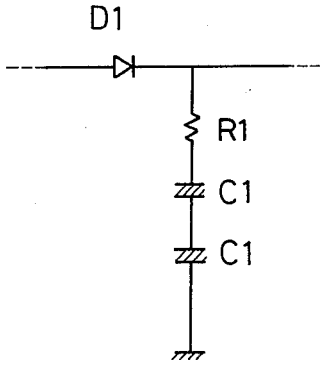
FIG. 4 shows connection of the capacitors in case of high power voltage.

The auxiliary power circuit 24 is composed of a diode D1 for preventing reverse current, a resistor R1 for limiting current and a capacitor C1 for charging, and is interposed between the voltage regulator 22 and an ignition switch SW. The capacitor C1 is preferably an electric double layer capacitor of a large capacity. In case that the withstand voltage of the capacitor C1 is not sufficient, a plurality of capacitors C1 may be connected in series as shown in FIG. 4.

The power-off detecting circuit 25 is composed of a transistor TR1, a resistors R2–R5 and a capacitor C2. The base of the transistor TR1 is connected through the resistor R3 to the ignition switch SW. The collector of the transistor TR1 is connected through the capacitor C2 to the actuator driving timer 21 and is also connected through the resistor R6 to the base of a transistor TR2 which will be hereinafter described. The resistor R2 is interposed between the base of the transistor TR1 and the ground. The resistor R4 is interposed between the collector of the transistor TR1 and the voltage regulator 22.

The discharging circuit 26 is composed of transistors TR2 and TR3 and resistors R6–R8. The base of the transistor TR2 is connected through the resistor R6 to the collector of the transistor TR1. The collector of the transistor TR2 is connected through the resistor R7 to the auxiliary power circuit 24. The base of the transistor TR3 is connected through the resistor R8 to the output of the actuator driving timer 21. The collector of the transistor TR3 is connected to the base of the transistor TR2. The whole constitution of the air-fuel control system 1 is similar to that shown in FIG. 1 and the explanation thereof will be omitted.

In operation, when the ignition switch SW is turned on to start the engine, electric current flows through the diode D1 and the resistor R1 and the capacitor C1 is charged. Time required to charge the capacitor C1 is dependent upon the resistance of the resistor R1 and the capacitance of the capacitor C1. For example, in case of the capacitance 0.22 F of the capacitor C1 and the resistance 10Ω of the resistor R1 (which are employed in this embodiment.), the charging operation of the capacitor C1 is completed in a few seconds.

As described in connection with FIG. 2, at the same time the ignition switch SW is turned on, a H signal is outputted from the actuator driving timer 21 to fully close the jets 5. However, it is preferred to eliminate this function in this embodiment.

At the next stage, when the ignition switch SW is turned off to stop the engine, power supply from the battery B is stopped and accordingly, the capacitor C1 of the auxiliary power circuit 24 serves to supply power to each circuit.

When the ignition switch SW is turned off, the potential of the base of the transistor TR1 becomes zero, in other words, the transistor TR1 goes off and accordingly, the potential of the collector of the transistor TR1 increases. In this way, the turning-off of the ignition switch SW is detected by the power-off detecting circuit 25. The increased potential of the collector of the transistor TR1 is triggered by the capacitor C2 and the triggered signal is fed to the actuator driving timer 21. As a result, the actuator driving timer 21 starts its timing operation to output a H signal during a given period of time.

When the H signal is outputted from the actuator driving timer 21, the jets 5 are fully closed by the needle vavles 4 in the same way as is previously described. In this state, the potential of the base of the transistor TR3 becomes a high level and the transistor TR3 goes on, and accordingly the transistor TR2 goes off.

When the actuator driving timer 21 terminates its timing operation of a predetermined period and outputs a L signal, the transistor TR3 goes off and the transistor TR2 goes on. Thusly, as the transistor TR2 becomes conductive, the electric charge in the capacitor C1 is rapidly discharged through the transistor TR2. Such a rapid discharge prevents faulty operation of the control circuit which may occur when the potential of the power source is gradually decreased by natural discharge.

As is described above, according to the first embodiment, the turning-off of the ignition switch SW is detected by the power-off detecting circuit 25 and the actuator driving timer 21 is operated during a given period of time according to the detecting signal to drive the actuator 7 by using the electric charge stored in the auxiliary power circuit 24 and fully close the jets 5 by the needle valves 4. By virtue of this operation, even when the actuator 7 or the control circuit 6A is frozen or fails to work to be uncontrolable, the air-fuel ratio of air-and-fuel mixture to be supplied to the engine is prevented to become lean in terms of fuel and the engine may be readily started.

Figure 5:
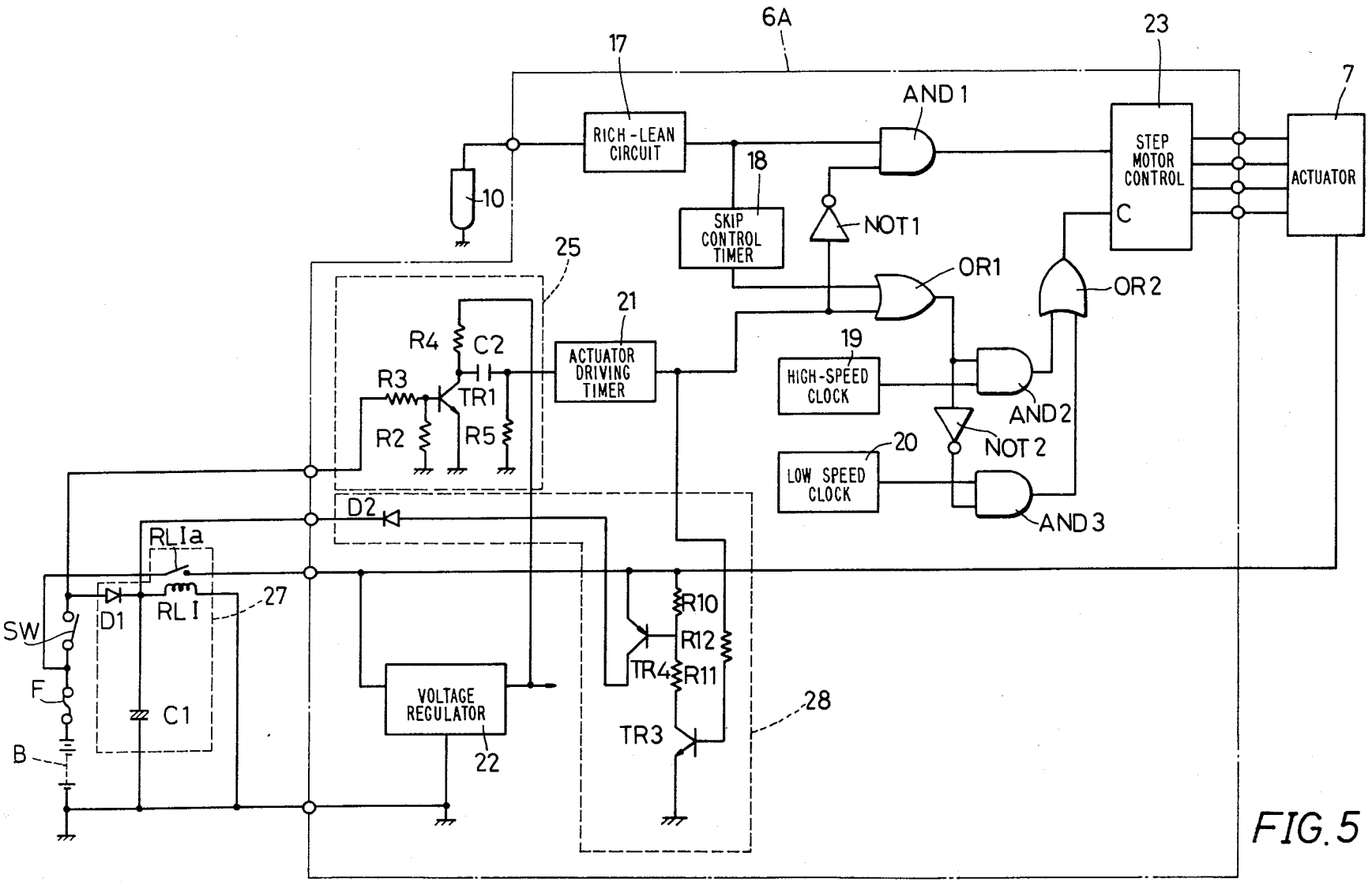
FIG. 5 is a block diagram of the control circuit according to the second embodiment.

Referring next to FIG. 5 which shows another embodiment of the invention, an auxiliary power circuit 27 is composed of a diode D1, a capacitor C1 and a relay RL1. The relay RL1 is interposed between the capacitor C1 and the ground. A normally opened contact RL1*a* of the relay RL1 is interposed between the power source and the voltage regulator 22.

A relay driving circuit 28 is composed of transistors TR3 and TR4, resistors R10, R11 and R12 and a diode D2. The base of the transistor TR3 is connected through the resistor R12 to the output of the actuator driving timer 21. The base of the transistor TR4 is connected through the resistor R11 to the collector of the transistor TR3. The collector of the transistor TR4 is connected through the diode D2 to the capacitor C1. The emitter of the transistor TR3 is connected to the ground. The base of the transistor TR4 and the resistor R11 are connected through the resistor R10 to the contact RL1*a*. The emitter of the transistor TR4 is connected to the contact RL1*a*.

Other constitution of this embodiment is similar to that in the first embodiment except that the discharging circuit 26 is not provided.

In operation, when the ignition switch SW is turned on so as to start the engine, the relay RL1 is energized and electric current is supplied through the contact RL1*a* to each circuit and is also supplied through the diode D1 to the capacitor C1.

Then, when the ignition switch SW is turned off so as to stop the engine, the potential of the base of the transistor TR1 becomes zero. In other words, the transistor TR1 goes off and accordingly, the potential of the collector of the transistor TR1 is increased. The increased potential is triggered by the capacitor C2 and in turn the triggered signal is fed to the actuator driving timer 21. As a result, the timer 21 starts its timing operation and outputs a H signal during a given period of time.

When the H signal is outputted from the timer 21, the actuator 7 is controlled in such a manner that the jets 5 are fully closed by the needle valves 4. At this time, the potential of the base of the transitor TR3 becomes a high level and accordingly the transistor TR3 goes on. In the same way, as the transistor TR4 goes on, the relay RL1 is supplied with current through the transistor TR4 and the diode D2 and is kept in its latched state. While the ignition switch SW is turned off and then the normally opened contact RL1*a* is turned on, the relay RL1 is supplied with current from the capacitor C1 and therefore it is held at ON state during this period.

At the next stage, when the actuator driving timer 21 terminates its timing operation during the predetermined period of time and outputs a L signal, both the transistor TR3 and the transistor TR4 go off. Accordingly, the relay RL1 is deenergized and the normally opened contact RL1*a* is turned off, thereby terminating power supply to the control circuit 6A and the actuator 7.

As is described above, according to the second embodiment, while the ignition switch SW is turned off and then the actuator driving timer 21 is operated during a given period of time, power is supplied through the relay RL1 of the auxiliary power circuit 27 to each circuit. Therefore, it is unnecessary to provide a capacitor capable of storing a large capacity and a discharging circuit as is used in the first embodiment.

The foregoing two embodiments are adapted to an air-fuel ratio control system which may change the amount of bleed air fed to a low-speed fuel system and a main fuel system in the carburetor to control the air-fuel ratio of air-and-fuel mixture. However, it should be noted that this invention may be adapted to an air-fuel ratio control system which may control the amount of fuel and an idle speed controller which may drive a throttle valve in the carburetor by a step motor to control the engine speeds at engine idling operation.

It should be also noted that the positional relation between the needle valves 4 and the jets 5 is not limited by the fully closed position of the jets 5. That is to say, the opening area of the jets 5 may be suitably predetermined, depending upon the object to be controlled.

While the invention has been shown and described in its preferred embodiments, it will be clear to those skilled in the arts to which it pertains that many changes and modifications may be made thereto without departing from the scope of the invention.

What is claimed is:

1. A start control device in a fuel supply system for an internal combustion engine which includes an actuator having a step motor therein as a drive source and a control circuit for controlling said step motor wherein said actuator serves to control at least one of the amounts of fuel and air to be supplied to said engine, said start control device comprising a power-off detecting circuit for detecting stop of power supply to said control circuit, an auxiliary power circuit for supplying electric power to said control circuit and said step motor for a predetermined period of time in response to a detecting signal from said power-off detecting circuit and an actuator driving timer for feeding a predetermined actuating signal to said step motor in response to said detecting signal from said power-off detecting circuit.

2. The device as defined in claim 1, and further comprising a discharging circuit connected to said auxiliary power circuit and said power-off detecting circuit.

3. The device as defined in claim 2, wherein said discharging circuit is composed of a transistor and a resistor.

4. The device as defined in claim 1, wherein said auxiliary power circuit is composed of a diode for preventing reverse current, a resistor for limiting current and a capacitor for charging.

5. The device as defined in claim 4, wherein said capacitor is an electric double layer capacitor of a large capacity.

6. The device as defined in claim 4, wherein said capacitor is connected in series.

7. The device as defined in claim 1, wherein said power-off detecting circuit is composed of a transistor, a resistor and a capacitor.

8. The device as defined in claim 1, wherein said auxiliary power circuit is composed of a diode, a capacitor and a relay.

9. The device as defined in claim 8 and further comprising a relay driving circuit connected to said auxiliary power circuit and the output of said actuator driving timer.

10. The device as defined in claim 9, wherein said relay driving circuit is composed of a transistor, a resistor and a diode.

* * * * *